US005775931A

United States Patent [19]

Jones

[11] Patent Number: 5,775,931

[45] Date of Patent: Jul. 7, 1998

[54] ELECTRICAL CONNECTOR LATCHING SYSTEM

[75] Inventor: Dennis Boyd Jones, Tustin, Calif.

[73] Assignee: Molex Incorporated, Lisle, Ill.

[21] Appl. No.: 642,728

[22] Filed: May 3, 1996

[51] Int. Cl.[6] ..... H01R 13/627

[52] U.S. Cl. ..... 439/358; 439/372

[58] Field of Search ..... 439/345, 347, 439/350, 357, 358, 953, 372

[56] References Cited

U.S. PATENT DOCUMENTS

| | | | |
|---|---|---|---|
| 4,225,206 | 9/1980 | Roman, Jr. | 439/358 X |
| 4,980,800 | 12/1990 | Furuta | 439/347 |
| 5,123,858 | 6/1992 | Haag et al. | 439/347 |
| 5,199,896 | 4/1993 | Mosquera | 439/329 |
| 5,320,554 | 6/1994 | Freer et al. | 439/347 |
| 5,340,329 | 8/1994 | Hirai | 439/357 |

FOREIGN PATENT DOCUMENTS

| | | | |
|---|---|---|---|
| 2-30075 | 1/1990 | Japan | H01R 13/631 |

*Primary Examiner*—Khiem Nguyen

*Attorney, Agent, or Firm*—Stacey E. Caldwell; James C. Paschall

[57] ABSTRACT

A latching system for mating electrical connectors includes a guide ferrule provided on a shell of a first connector for receiving an appropriate guide post on the mating electrical connector. A latch member pivotally mounted on the guide ferrule includes a latch end latchingly engageable with a groove in the guide post. A housing of resilient dielectric material is overmolded about portions of the shell and includes an integral spring portion for biasing the latch member in its latch position.

10 Claims, 3 Drawing Sheets

ELECTRICAL CONNECTOR LATCHING SYSTEM

FIELD OF THE INVENTION

This invention generally relates to the art of electrical connectors and, particularly, to a system for latching an electrical connector with a complementary electrical connector or other connecting device.

BACKGROUND OF THE INVENTION

In mating electrical connector systems, it often is important to lock or latch two mating connectors to one another for ensuring proper and complete interconnection of the connector terminals and to further ensure ongoing connection of the connectors. This is particularly critical in environments where the connector assembly is subject to vibration or movement or low insertion and/or withdrawal forces where the connectors may become unintentionally or inadvertently disconnected. Unfortunately, durable latching systems such as screws or bolts or other labor-intensive systems can be expensive in terms of component and assembly costs. Less expensive latches, such as integrally molded plastic systems, often are inadequate for connector systems intended for repeated cycling.

A known type of latching system is a "quick release" latching system which includes thumb or finger actuators which, when depressed, allow for low or zero force unmating of the connectors. Such systems may provide an "audible click" to indicate complete mating of the two connectors. However, these latching systems can be expensive since the mechanisms generally require a number of components most or all which are typically fabricated of metallic components.

A latching system with relatively few components, requiring fewer points of attachment and resulting in less wear and less associated assembly and component costs would be mechanically and economically desirable. Such a latching system should have as few components as possible, each possessing good individual wear characteristics.

The subject invention is directed to solving the problems discussed above in an effective latching system for an electrical connector which requires as few components as possible and utilizes the already existing components of the connector as the attachment components for the latching system.

SUMMARY OF THE INVENTION

An object, therefore, of the invention is to provide a new and improved latching system for an electrical connector of the character described.

In the exemplary embodiment of the invention, an electrical connector includes a shell having a forward connecting section for connection with a complementary electrical connector in a mating direction. A guide ferrule on the shell is provided for receiving an appropriate guide post on the complementary electrical connector. A latch member extends in the mating direction alongside the connecting section and includes a fixed portion mounted on the guide ferrule and a free latch end latchingly engageable with the guide post. Therefore, the already existing guide ferrule and guide post components of the connector assembly are utilized as the attachment components for the latching system.

As disclosed herein, the fixed portion of the latch member is a fulcrum about which the free latch end of the latch member is pivotally movable between a latch position in latching engagement with the guide post on the complementary connector, and a release position disconnected from the complementary connector. The free latch end of the latch member projects from one side of the fulcrum, and the latch member includes an integral free actuator end projecting from the opposite side of the fulcrum. Preferably, the latch member is a one-piece structure stamped and formed of durable sheet metal material.

In the preferred embodiment, a pair of the guide ferrules are provided on respective opposite sides of the connecting section. Correspondingly, a pair of the latch members are mounted on the guide ferrules and extend in the mating direction along the opposite sides of the connecting section.

Lastly, another feature of the invention is to utilize a dielectric housing of the connector as a component of the latching system. In particular, the connector includes a housing of resilient dielectric material overmolded about portions of the shell. The housing includes an integrally molded spring portion or button for biasing each latch member to its latch position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
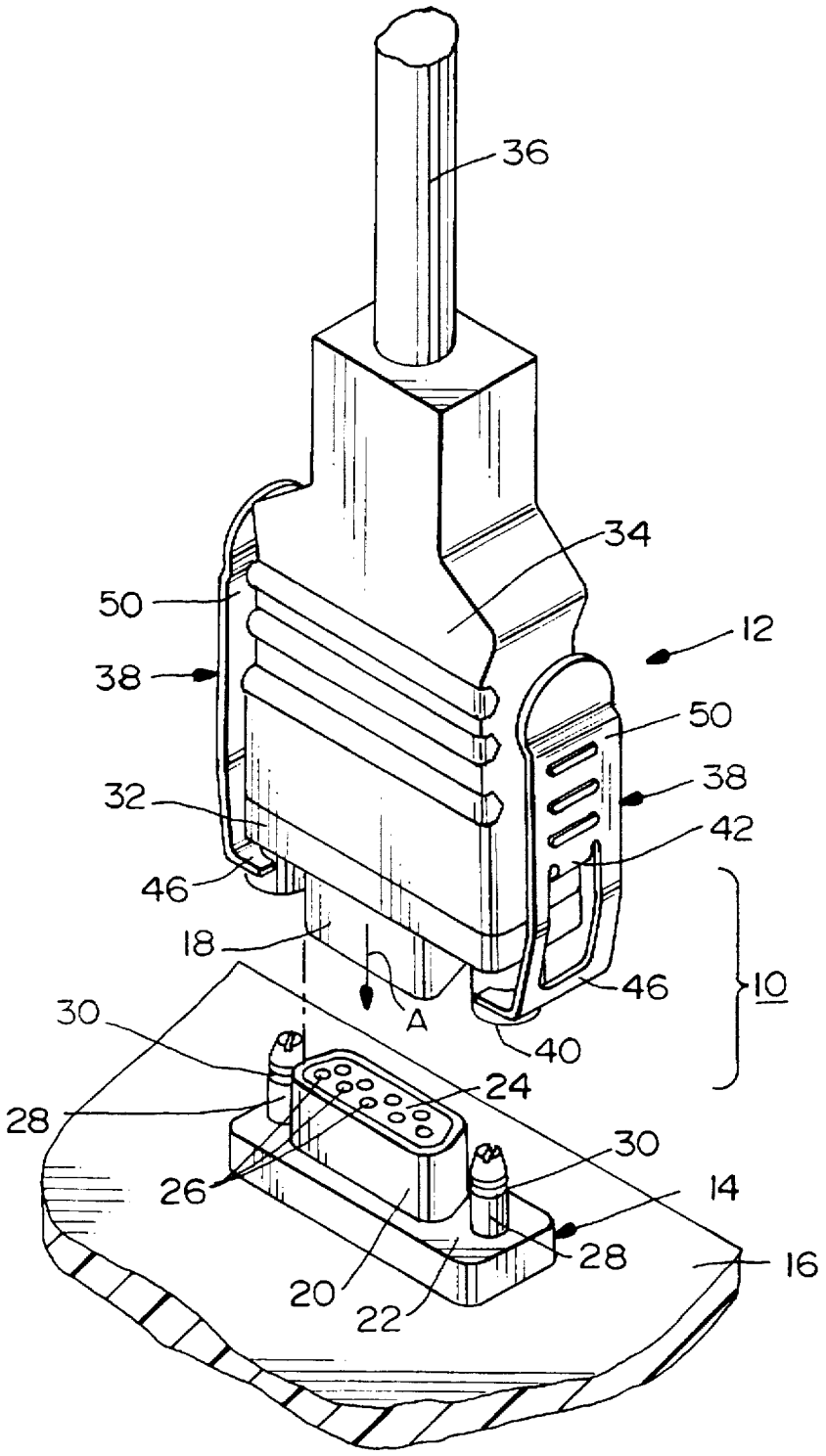
FIG. 1 is an exploded perspective view of an electrical connector assembly embodying the latching system of the invention.

Referring to the drawings in greater detail, and first to FIG. 1, the invention is embodied in an electrical connector assembly 10 which includes a first or socket connector, generally designated 12, and a complementary or plug connector, generally designated 14. The plug connector is mounted on a printed circuit board 16, and socket connector 12 is mateable with the plug connector in a mating direction indicated by arrow "A". Socket connector 12 includes a D-shaped connecting section or socket 18 which receives a D-shaped connecting section or plug 20 of plug connector 14, as is known in the art. Both connectors house complementary interengaging electrical terminals (not shown), as is also known in the art.

Plug connector 14 includes a metal base or flange 22 integrally die-cast with connecting section or plug 20. A dielectric insert 24 is disposed in plug 20 and has a plurality of terminal-receiving passages 26. A pair of guide posts 28 are disposed at opposite ends of plug 20 and project from base 22 toward mating socket connector 12. Each guide post 28 has a circumferential groove 30 for receiving the latch members of socket connector 12, as described below.

Still referring to FIG. 1, socket connector 12 includes a metal shell 32 integrally die-cast with forward connecting section or socket 18. A housing 34 of resilient dielectric material is overmolded substantially about shell 32 and the terminating end of an electrical cable 36 which includes wires or conductors terminated to the terminals within socket connector 12. A pair of latch members, generally designated 38, extend in mating direction "A" along opposite sides of socket connector 12 and connecting section or socket 18. Lastly, a pair of guide ferrules 40 are disposed on opposite sides of socket 18 for receiving guide posts 28 of plug connector 14, as will be described in greater detail hereinafter.

Figure 2:
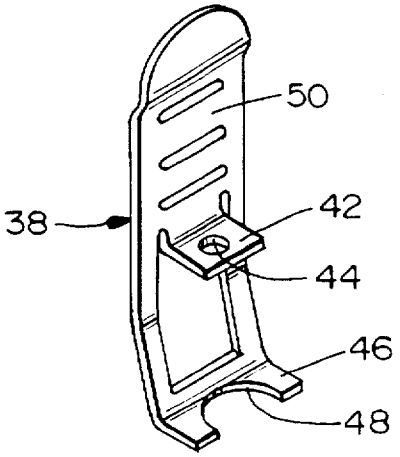
FIG. 2 is a perspective view of one of the latch members.

Referring to FIG. 2 in conjunction with FIG. 1, each latch member 38 includes a fixed portion 42 having a hole 44 therethrough and which defines a fulcrum for the latch member. A free latch end 46 of each latch member includes an arcuate cutout 48. The free latch end 46 projects from one side of fulcrum portion 42, and a free actuator end 50 projects from the opposite side of the fulcrum. Each latch member 38 is a one-piece structure stamped and formed of durable sheet metal material.

Figure 3:
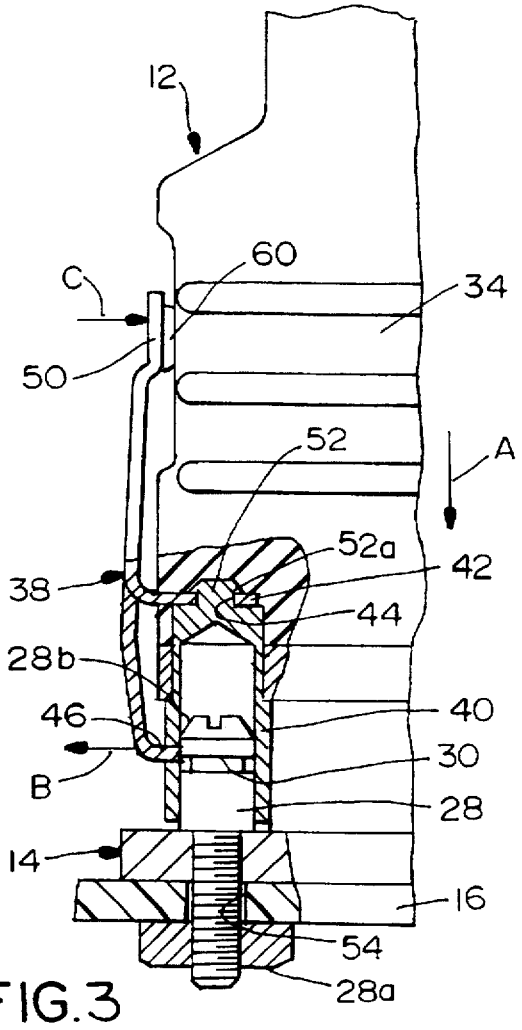
FIG. 3 is a fragmented elevational view of the connectors of the assembly about to be mated, with one of the latch members in its release position.

FIG. 3 shows socket connector 12 partially mated with plug connector 14. This partially mated condition can correspond to the socket connector just prior to full mating with the plug connector, or the socket connector just prior to disconnection from the plug connector. In either event, it can be seen that one of the guide posts 28 of the plug connector is inserted into one of the guide ferrules 40 of the socket connector. It is understood that there are two guide posts 28 and, correspondingly, two guide ferrules 40 as shown in FIG. 1.

FIG. 3 also shows how latch members 38 are mounted on socket connector 12. In particular, each guide ferrule 40 has a projecting mounting boss 52 which extends through hole 44 in fulcrum portion 42 of the latch member. The tip of the boss is swaged or crushed, as at 52*a*, to expand outwardly and securely fix the latch member as shown in FIG. 3. In this fixed condition, free actuator end 50 of the latch member extends rearwardly of fulcrum portion 42 and free latch end 46 extends forwardly from the opposite side of fulcrum portion 42.

FIG. 3 also shows that each guide post 28 has a threaded shaft portion 28*a* which extends through a hole 54 in base or flange 22 of the plug connector and through printed circuit board 16. A nut 56 is threaded onto shaft 28*a* on the opposite side of flange 24 to securely fix the guide post to the plug connector and the plug connector to the printed circuit board.

During mating (or unmating) of socket connector 12 with plug connector 14 in the direction of arrow "A" (FIG. 3), cutout area 48 (see FIG. 2) contacts distal end 28*b* of guide post 28, which is effective to bias the free latch end 46 of the latch member outwardly in the direction of arrow "B". Consequently, integral free actuator end 50 of the latch member is biased inwardly in the direction of arrow "C".

Figure 4:
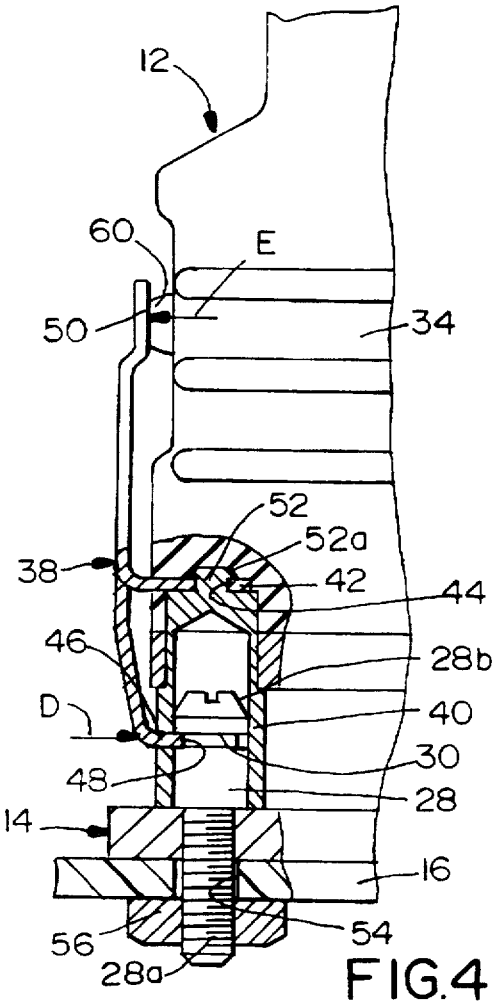
FIG. 4 is a view similar to that of FIG. 3, with the latch member in its latch position.

When socket connector 12 is fully mated with plug connector 14, cutout area 48 at free latch end 46 of latch member 38 moves into circumferential groove 30 of guide post 28 in the direction of arrow "D" shown in FIG. 4. The opposite free actuator end 50 of the latch member returns outwardly in the direction of arrow "E". Therefore, FIG. 4 shows the fully mated condition of the connectors, with the latched condition of the latch members.

Another feature of the invention is the provision of an integral spring means on resilient dielectric housing 34 for assisting in biasing the latch members toward their latch position. More particularly, as seen in FIGS. 3 and 4, an integral spring portion in the form of a boss or "bump" 60 is molded integrally with the resilient overmolded housing and projects outwardly from each side thereof directly beneath or behind free actuator end 50 of each latch member. The resilient spring boss 60 is effective to bias the free actuator end 50 outwardly in the direction of arrow "E" which, in turn, biases free latch end 46 of the latch member inwardly about fulcrum portion 42 in the direction of arrow "D".

From the foregoing, it can be seen that the latching system of the invention utilizes already existing components (i.e. guide posts 28 and guide ferrules 40) of the connector assembly for mounting latch members 38 as well as for providing engageable latch means for the latch members. Guide posts 28 are modified only slightly by the provision of circumferential grooves 30, and guide ferrules 40 are modified only slightly by the provision of mounting bosses 52. Otherwise, no additional components other than the latch arms have been added to the connector assembly to provide the latching system. Even the integrally molded spring bosses 60 are the result of only minor modifications to overmolded housing 34 to provide the auxiliary spring or biasing feature for the latch members without the addition of other separate components to the connector assembly.

Figure 5:
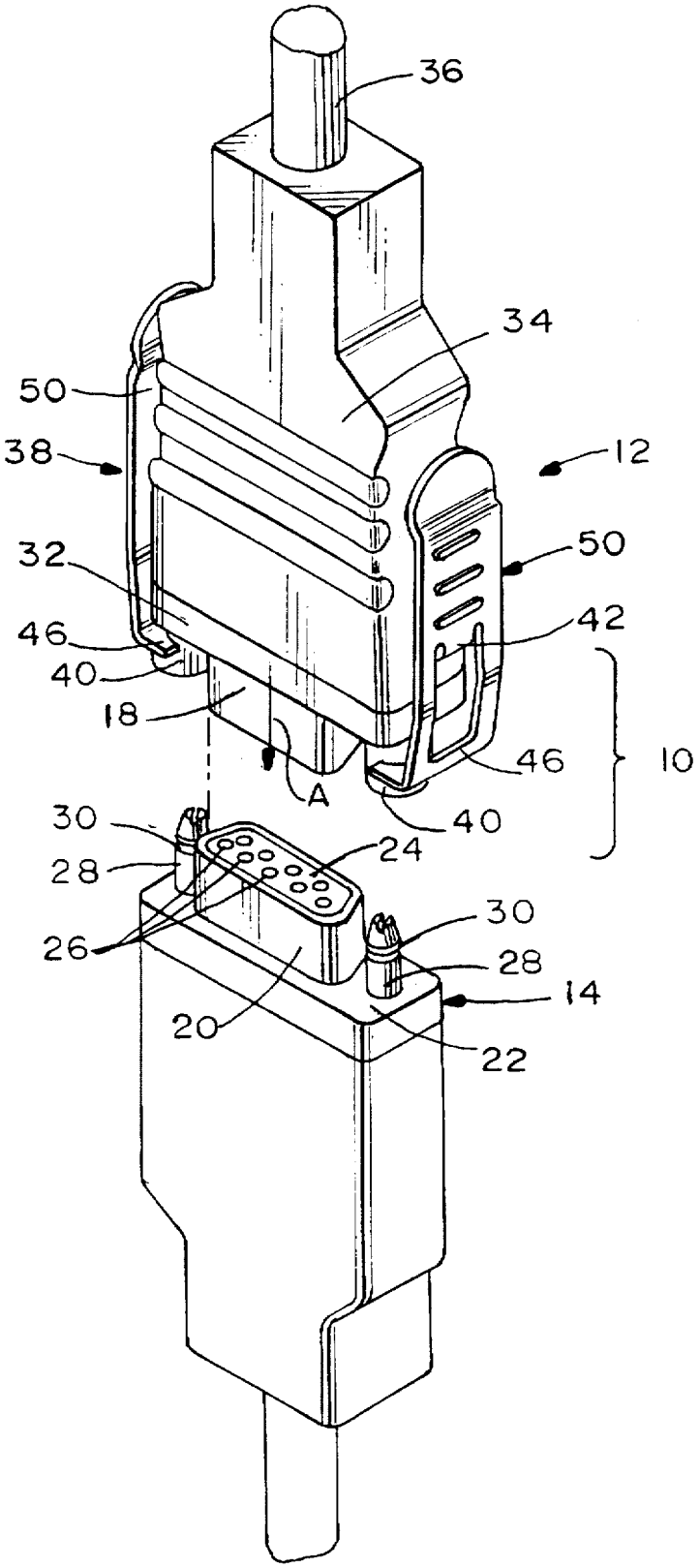
FIG. 5 is an alternate embodiment of a mating electrical connector assembly embodying the latching system of the invention.

As seen in FIG. 5, the latching system of the invention can be used in a pair of mating connectors wherein both connectors are overmolded about a cable instead of one being mounted on a circuit board. The latching system in both applications is the same.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

a shell having a forward connecting section for connection with a complementary electrical connector in a mating direction;

a guide ferrule on the shell for receiving an appropriate guide post on the complementary electrical connector; and a one-piece stamped and formed latch member extending in said mating direction alongside said connecting section and including a mounting portion securely fixed on the guide ferrule and a free latch end latchingly engageable with a latching surface on the guide post.

2. The electrical connector of claim 1 wherein the fixed portion of said latch member comprises a fulcrum about which the free latch end of the latch member is pivotally movable between a latch position in latching engagement with the guide post on the complementary electrical connector and a release position disconnected from the guide post on the complementary connector.

3. The electrical connector of claim 2 wherein the free latch end of said latch member projects from one side of the fulcrum, and the latch member includes an integral free actuator end projecting from the opposite side of the fulcrum.

4. The electrical connector of claim 2, including a housing of resilient dielectric material overmolded about portions of the shell and including an integral spring portion for biasing the latch member in the latch position.

5. The electrical connector of claim 1, including a pair of said guide ferrules on respective opposite sides of the connecting section, and a pair of said latch members mounted on the guide ferrules and extending in said mating direction along said opposite sides of the connection section.

6. An electrical connector, comprising:

a shell having a forward connecting section for connection with a complementary electrical connector in a mating direction;

a pair of guide ferrules on respective opposite sides of the connection section of the shell for receiving an appropriate pair of guide posts on the complementary electrical connector; and a pair of latch members extending in said mating direction along opposite sides of said connecting section, each latch member being a one-piece metal structure and including a fulcrum portion securely fixed to a respective one of the guide ferrules, a free latch end projecting from one side of the fulcrum portion and pivotally movable between a latch position in latching engagement with a respective one of the guide posts on the complementary electrical connector and a release position disconnected from the complementary connector, and a free actuator end projecting from the opposite side of the fulcrum portion.

7. The electrical connector of claim 6, including a housing of resilient dielectric material overmolded about portions of the shell and including an integral spring portion for biasing each latch member to its latch position.

8. A latching system for an electrical connector assembly, comprising:

an electrical connector including a shell having a forward connecting section for connection with a complementary electrical connector in a mating direction;

a guide ferrule on one of said shell and said complementary electrical connector for receiving an appropriate guide post on the other of said shell and said complementary electrical connector; and a unitary latch member including a mounting portion securely fixed on the one of the guide ferrule and guide post which is on the shell and a free latch end latchingly engageable with the other of guide ferrule and guide post on the complementary electrical connector.

9. The electrical connector of claim 8 wherein the fixed portion of the latch member comprises a fulcrum about which the free latch end of the latch member is pivotally movable between a latch position and a release position.

10. The electrical connector of claim 9, including a housing of resilient dielectric material overmolded about portions of the shell and including an integral spring portion for biasing the latch member toward the latch position.

* * * * *